US009739499B2

(12) United States Patent
Tu et al.

(10) Patent No.: US 9,739,499 B2
(45) Date of Patent: Aug. 22, 2017

(54) DUAL-MODE POWER STEALING FOR A CLIMATE CONTROL SYSTEM CONTROLLER

(71) Applicant: Emerson Electric Co., St. Louis, MO (US)

(72) Inventors: Lihui Tu, Xi'an (CN); Cuikun Chu, Xi'an (CN); Zhongliang Xu, Xi'an (CN); Long Huang, Xi'an (CN)

(73) Assignee: Emerson Electric Co., St. Louis, MO (US)

( * ) Notice: Subject to any disclaimer, the term of this patent is extended or adjusted under 35 U.S.C. 154(b) by 706 days.

(21) Appl. No.: 14/222,847

(22) Filed: Mar. 24, 2014

(65) Prior Publication Data

US 2014/0312694 A1 Oct. 23, 2014

(30) Foreign Application Priority Data

Apr. 22, 2013 (CN) ..... 2013 1 0142164
May 9, 2013 (CN) ..... 2013 1 0168169

(51) Int. Cl.
*H02J 1/00* (2006.01)
*F24F 11/00* (2006.01)

(52) U.S. Cl.
CPC ..... *F24F 11/006* (2013.01); *Y10T 307/469* (2015.04)

(58) Field of Classification Search
CPC ..... F24F 11/006
See application file for complete search history.

(56) References Cited

U.S. PATENT DOCUMENTS

| | | | | |
|---|---|---|---|---|
| 5,127,464 | A | 7/1992 | Butler et al. | |
| 5,192,874 | A | 3/1993 | Adams | |
| 5,736,795 | A * | 4/1998 | Zuehlke | H02M 5/293 307/125 |
| 5,903,139 | A | 5/1999 | Kompelien | |
| 6,998,816 | B2 | 2/2006 | Wieck et al. | |
| 7,476,988 | B2 | 1/2009 | Mulhouse et al. | |
| 7,755,220 | B2 | 7/2010 | Sorg et al. | |
| 7,826,815 | B2 | 11/2010 | Ajram et al. | |
| 8,110,945 | B2 | 2/2012 | Simard et al. | |
| 2012/0155137 | A1 | 6/2012 | Simard et al. | |

FOREIGN PATENT DOCUMENTS

| | | |
|---|---|---|
| CN | 202353446 U | 7/2012 |
| CN | 202383451 U | 8/2012 |

OTHER PUBLICATIONS

Honeywell, "Power Stealing Thermostats," Honeywell Inc. 6 pages, Downloaded Aug. 1, 2012. 50-8433.*

(Continued)

*Primary Examiner* — Daniel Cavallari
(74) *Attorney, Agent, or Firm* — Harness, Dickey & Pierce, P.L.C.

(57) ABSTRACT

A controller for use in a climate control system. The controller, which may be a wireless-enabled thermostat, includes a power stealing circuit configured to steal power from a first load that is in an "on" mode and from a second load that is in an "off" mode. The stealing is performed from the first and second loads at the same time. Sufficient power can be stolen to support substantially constant operation of a transceiver of the controller.

24 Claims, 6 Drawing Sheets

(56) References Cited

Figure 1:
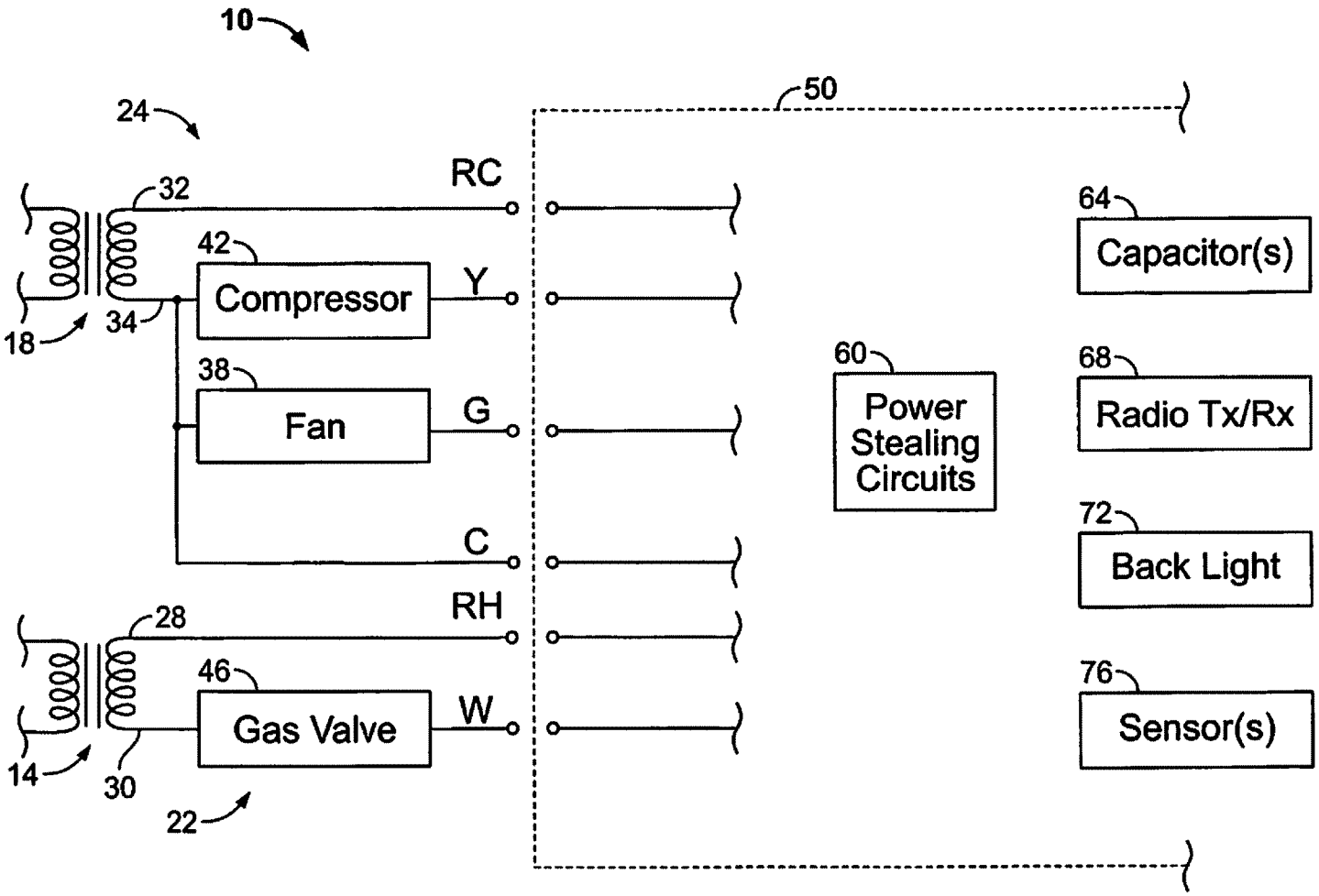

OTHER PUBLICATIONS www.ritetemp-thermostats.com/60XX/6080.html; 2008 ©; 12 pgs.
Radio Thermostat Corporation of America; CT80 and CT30 Thermostats; Mar. 25, 2012; 1 pg.
http://support.nest.com/article/1st-generation-Nest-Learning-Thermostat-Installation-Guide; updated Oct. 11, 2012; 6 pgs.
Chinese Office Action issued in Chinese Utility Patent Application No. 201310168169.3 which the instant application claims priority to, dated Dec. 30, 2015; 5 pgs.

* cited by examiner

DUAL-MODE POWER STEALING FOR A CLIMATE CONTROL SYSTEM CONTROLLER

CROSS-REFERENCE TO RELATED APPLICATIONS

This application claims the benefit and priority of Chinese Patent of Invention Application No. 201310142164.3 filed Apr. 22, 2013 and Chinese Patent of Invention Application No. 201310168169.3, filed May 9, 2013. The entire disclosures of each of the above applications are incorporated herein by reference.

FIELD

The present disclosure relates to apparatus, systems and methods for dual-mode power stealing for a climate control system controller.

BACKGROUND

This section provides background information related to the present disclosure which is not necessarily prior art.

Digital thermostats and other climate control system controllers typically have microcomputers and other components that continuously use electrical power. Various thermostats may utilize "off-mode" power stealing to obtain operating power. That is, when a load (e.g., a compressor, fan, or gas valve) in a climate control system has been switched off, power may be stolen from that "off-mode" load's circuit to power the thermostat.

SUMMARY

This section provides a general summary of the disclosure, and is not a comprehensive disclosure of its full scope or all of its features.

Exemplary embodiments or implementations are disclosed of methods, apparatus, and systems for dual-mode power stealing for a controller. An exemplary implementation is directed to a controller for use in a climate control system. In this example, the controller includes a power stealing circuit configured to steal power from a first load that is in an "on" mode and from a second load that is in an "off" mode. The stealing is performed from the first and second loads at the same time.

Another exemplary embodiment is directed to a controller for use in a climate control system. The controller includes a power stealing circuit and a processor. The processor detects "on-mode" operation of a first load of the climate control system. In response to the detecting, the processor selectively connects the power stealing circuit with a second load in an "off" mode. The power stealing circuit thus is configured to steal power from the first and second loads at the same time.

Another exemplary implementation is directed to a control-performed method of stealing power in a climate control system to operate a controller of the climate control system. In this example, the method includes monitoring a plurality of loads of the climate control system, and detecting that one of the loads is in an "on" mode. In response to the detecting, power stealing is actuated from one of the loads that is in an "off" mode. The method may be performed while power is being stolen from the one of the loads that is in the "on" mode.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a diagram of an exemplary climate control system including a thermostat in accordance with an exemplary embodiment of the present disclosure; and FIGS. 2 through 6 are diagrams of exemplary power stealing circuits in accordance with exemplary embodiments of the present disclosure.

DETAILED DESCRIPTION

Example embodiments will now be described more fully with reference to the accompanying drawings.

The inventors have observed that although various thermostats may be configured to steal power from an "off-mode" load, some thermostats may be configured to steal power from an "on-mode" load, i.e., from a load while the load is in operation. The inventors have also observed that thermostats typically perform power stealing in only one mode or the other. The inventors have provided and disclose herein various embodiments and implementations of apparatus, systems and methods for power stealing from "off-mode" and "on-mode" loads at the same time. In various example embodiments, sufficient power may be stolen, e.g., to provide substantially continuous power to a radio transceiver of a wireless-enabled thermostat.

One example embodiment of a climate control system is indicated generally in FIG. 1 by reference number 10. The climate control system 10 includes two power sources, e.g., two transformers 14 and 18 for providing power respectively to a heating subsystem 22 and a cooling subsystem 24. The heating subsystem transformer 14 has a hot (typically 24-volt) side 28 and a common, i.e., neutral, side 30. The cooling subsystem transformer 18 has a hot (typically 24-volt) side 32 and a common, i.e., neutral, side 34. The cooling subsystem 24 includes a fan 38 and a compressor 42 connected on the common side 34 of the transformer 18. The heating subsystem 22 includes a furnace gas valve 46 connected on the common side 30 of the heating subsystem transformer 14. In the present example, a C terminal is provided from a common C wire connected, e.g., with the common side 34 of the transformer 18. In various alternative embodiments of the disclosure, no C wire is provided.

In one example embodiment, a thermostat 50 is provided for controlling operation of the climate control system 10. The thermostat 50 may activate one or more relays and/or other switching devices(s) (not shown in FIG. 1) to activate the heating subsystem 22 or cooling subsystem 24. When, e.g., a user operates the thermostat 50 to cause the climate control system 10 to provide heating, the thermostat 50 turns on the heating subsystem 22 and gas valve 46 by using a relay or other switching device to connect a "hot" terminal RH to a load terminal W. To provide cooling, the thermostat 50 may turn on the compressor 42 and/or fan 38 by using one or more relays or other switching device(s) to connect a "hot" terminal RC to load terminals Y and/or G.

An example power stealing circuit 60 may obtain power from the transformers 14 and/or 18 for the thermostat 50. In various embodiments of the disclosure, and as further described below, the power stealing circuit 60 may utilize "off-mode" and "on-mode" power stealing at the same time. Stolen power may be used for powering one or more components of the thermostat 50. Stolen power also may be stored in one or more optional capacitors 64 and/or may be used, e.g., to power one or more circuits ancillary to the thermostat 50, including but not limited to a radio transceiver 68, a back light 72, and/or one or more sensors 76. In various embodiments, power from a battery (not shown) may be provided in the event, e.g., that power stealing is inoperable.

It should be noted generally that thermostat embodiments and/or power stealing circuit embodiments in accordance with various aspects of the disclosure could be installed in other types of climate control systems, including but not limited to systems having a single transformer, heat-only systems, cool-only systems, heat pump systems, etc. In some embodiments a C terminal may be provided, e.g., from the common side 30 of the transformer 14. In some other embodiments, a thermostat may not be provided with a connection to a common C wire. Further, although the climate control system 10 shown in FIG. 1 provides single-stage heat and single-stage cooling, in various embodiments a thermostat having a power stealing circuit as described herein may be provided in a climate control system having multiple stages of heating and/or cooling.

Figure 2:
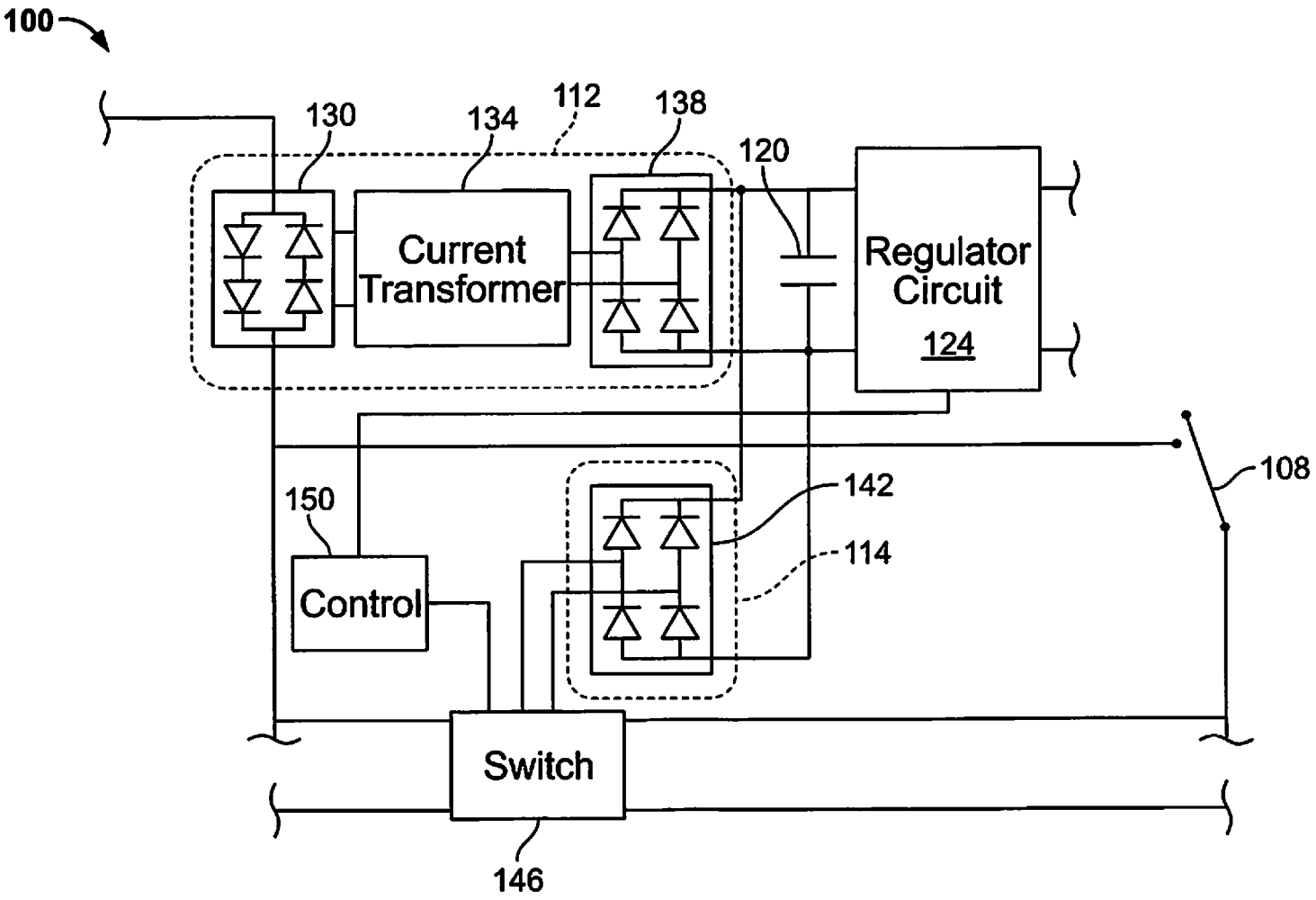

An example embodiment of a power stealing circuit is indicated in FIG. 2 by reference number 100. The power stealing circuit 100 may be adapted for use in a thermostat for any one of a plurality of climate control system types, e.g., systems having a single transformer, two-transformer systems, heat-only systems, cool-only systems, heat pump systems, etc. The power stealing circuit 100 may be configured to steal power through one or more climate control system loads. In various embodiments, and as further described below, the power stealing circuit 100 is configured to steal power from a load that is in an "on" mode and from another load that is in an "off" mode. In some example embodiments, power can be stolen, e.g., from both "on-mode" and "off-mode" loads at the same time. A switch 108, which may be e.g., a jumper, a relay, transistor-based, etc., is provided to connect the power stealing circuit 100 selectively to one transformer, to two transformers, or to one of two transformer(s) (not shown) of a climate control system. In some example embodiments, the switch 108 is configurable, e.g., manually when a thermostat that includes the power stealing circuit 100 is installed in a climate control system.

The power stealing circuit 100 includes an "on-mode" stealing circuit 112 and an "off-mode" stealing circuit 114. The "on-mode" stealing circuit 112 and "off-mode" stealing circuit 114 are connected across a capacitor 120 and regulator circuit 124, e.g., a buck circuit. The "on-mode" stealing circuit 112 includes a current sensor 130, a step-down current transformer 134, and a rectifier 138. The "off-mode" stealing circuit 114 includes a rectifier 142.

The power stealing circuit 100 also includes a switch 146 controlled by a control 150, e.g., a microprocessor. In various embodiments, the control 150 is a processor control unit (MCU) of a thermostat in which the power stealing circuit 100 is included. The control 150 may be made by, e.g., Texas Instruments Inc., Freescale Semiconductor, Inc., etc. Thus the control 150 may include a processor and memory configured to control thermostat functions, including, e.g., calling for heat or cooling in response to user input to the thermostat. As further described below, the control 150 is configured to detect operation of a load that is in the "on" mode. In response to the detecting, the control 150 may determine which load is in the "off" mode and connect the "off-mode" stealing circuit 114 with the "off-mode" load, so that power may be stolen from the "off-mode" load. For example, if a user has selected heating, then the control 150 can select a cooling circuit, e.g., through a Y circuit as shown in FIG. 1, from which to steal power. In such event, the control 150 can control the switch 146 to select the Y circuit. Conversely, if the user has selected cooling, then the control 150 can select a heating circuit, e.g., through a W circuit as shown in FIG. 1, from which to steal power. In such event, the control 150 can control the switch 146 to select the W circuit. If the user has selected an "auto" thermostat setting, then the control 150 can dynamically select an "off-mode" load as the loads are switched, e.g., from heat to cooling and vice versa.

In various embodiments and as further described below, stolen power may be transferred from one or more climate control system "hot" wires along one or more paths to produce a DC output voltage, e.g., for operating a radio transceiver and/or other thermostat components. Component values for power stealing circuits may vary dependent on the climate control systems in which the power stealing circuits are used. In one example embodiment the current sensor 130 may include four 1N4004 diodes, and the capacitor 120 may be a 4000 uF capacitor.

Figure 3:
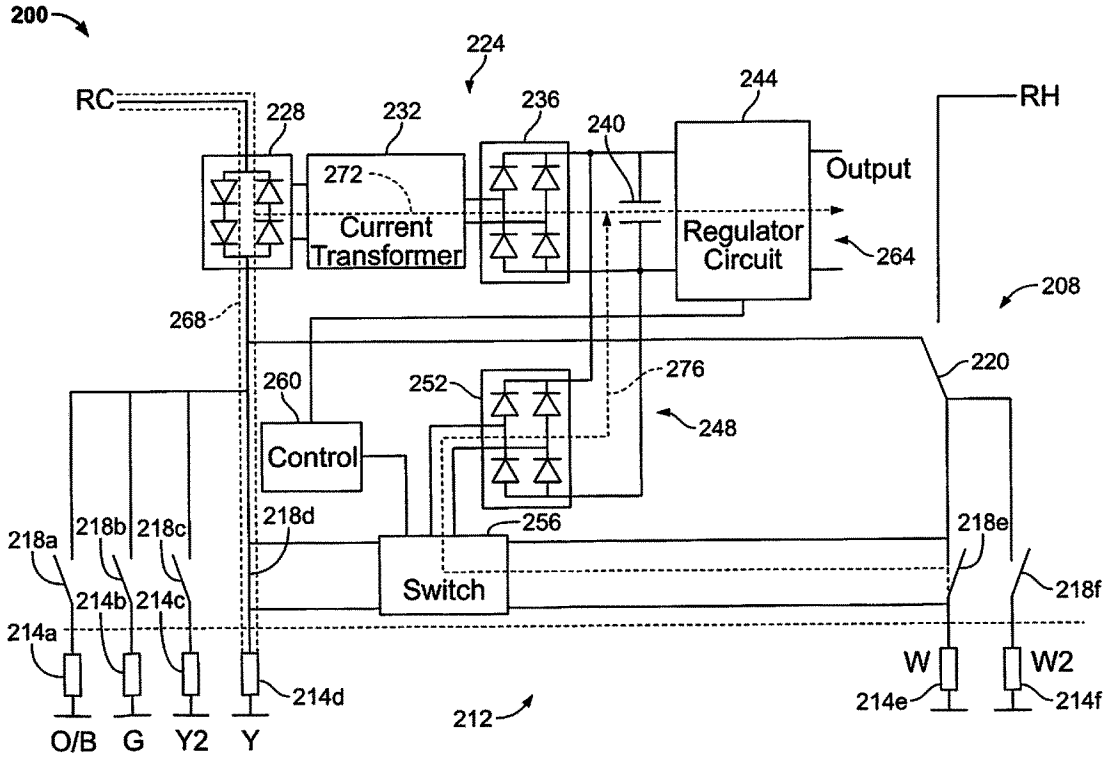
Figure 4:
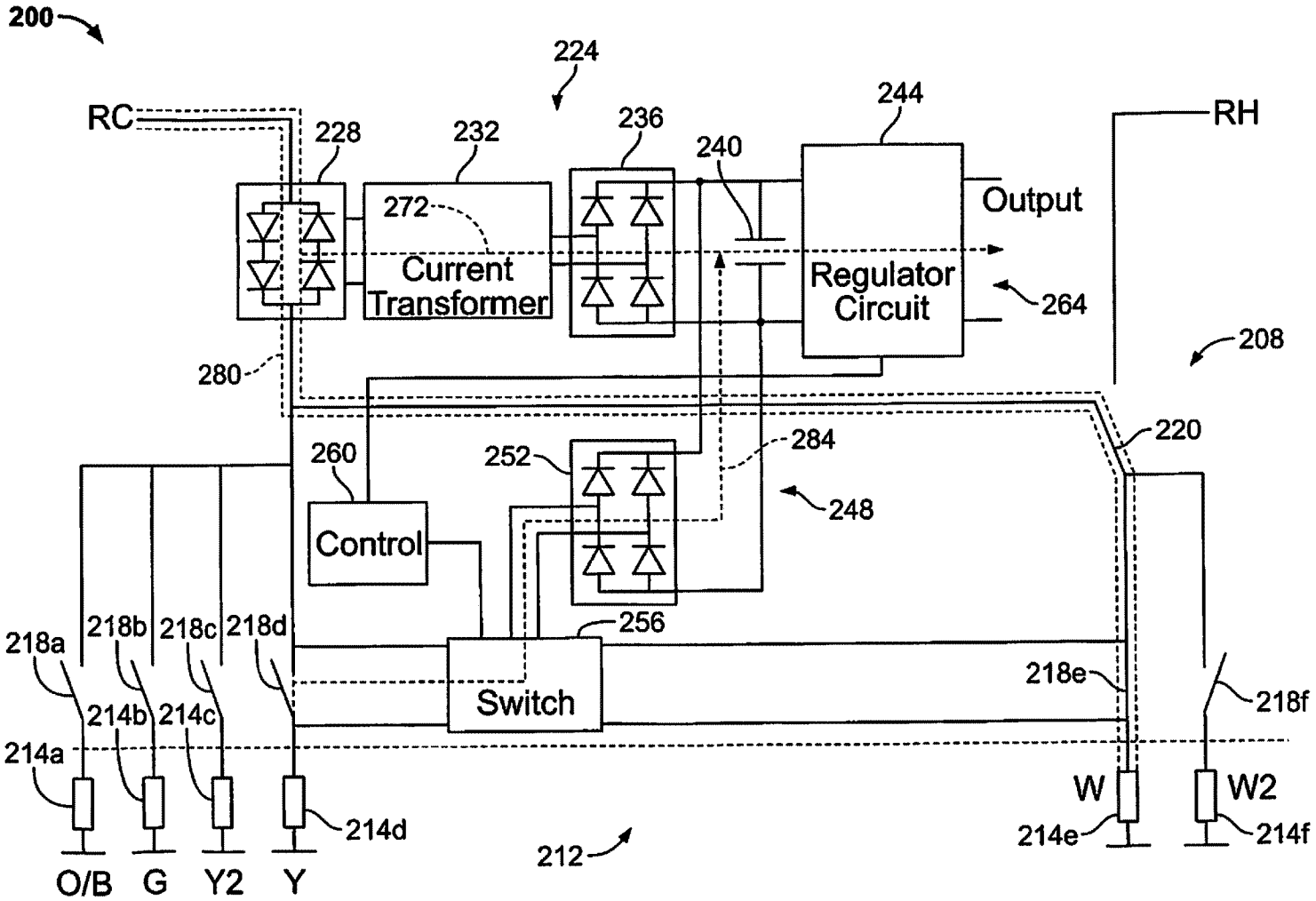

Another example embodiment of a thermostat power stealing circuit is indicated generally in FIGS. 3 and 4 by reference number 200. The power stealing circuit 200 is configured in a thermostat 208 of an example climate control system 212. Possible loads 214*a*-214*f* of the climate control system 212 include two furnace heating stages 214*e* and 214*f* that may be powered through wires W and W2, two cooling stages 214*c* and 214*d* that may be powered through wires Y2 and Y, a fan 214*b* powered through a wire G and a heat pump reversing valve 214*a* powered through a wire O/B. Thermostat relays 218*a*-218*f* are selectively operable to switch each load 214*a*-214*f* into or out of operation in the climate control system 212. The climate control system 212 is configured to use one transformer (not shown). A switch 220 (e.g., a jumper, relay, etc.) is configured to connect all of the loads 214*a*-214*f* with a single "hot" wire RC.

An "on-mode" stealing circuit 224 of the power stealing circuit 200 includes a current sensor 228, e.g., a clipping circuit connected between the "hot" wire RC and a current transformer 232. A rectifier 236, e.g., a full-wave bridge rectifier, is connected between the current transformer 232 and a capacitor 240. The capacitor 240 is provided between and in parallel with the rectifier 236 and a regulator circuit 244, e.g., a buck circuit. An "off-mode" stealing circuit 248 of the power stealing circuit 200 includes a rectifier 252, e.g., a full-wave bridge rectifier. The rectifier 252 is connected with a switch 256 and also is connected across the capacitor 240. The switch 256 is controlled by a control 260. The control 260 detects the voltage of the capacitor 240. If the voltage is high enough (e.g., over fifteen volts), the control 260 may control the regulator circuit 244 to output the voltage 264 to the load. Otherwise, the control 260 doesn't start the regulator circuit 244. The regulator circuit 244 may include, e.g., an inductor and capacitor for alternately storing and outputting energy.

It should be understood generally that other or additional components could be used in place of and/or in addition to various components described herein. For example, in some embodiments, one or more half-wave rectifiers could be used in place of one or more full-wave rectifiers. Additionally or alternatively, other or additional types of regulator circuits could be used, e.g., other or additional converter circuits, boost circuits, integrated circuits, etc.

In the present example embodiment, the control 260 manages power stealing and manages the provision of stolen power through the regulator circuit 244 to components of the thermostat 208. Thus, for example, the control 260 monitors voltage across the capacitor 240 and starts or shuts off operation of the regulator circuit 244. If the voltage across the capacitor 240 is too low, the output of the regulator circuit 244 can't support the load. The control 260 also is configured to control the switch 256 for selectively connecting an "off-mode" load with the "off-mode" stealing circuit 248.

The power stealing circuit 200 may be operable, e.g., as follows. Where, e.g., a user of the climate control system 212 operates the thermostat 208 to request cooling, the climate control system 212 may perform cooling, e.g., as shown in FIG. 3. The relay 218*d* is closed and thus the first cooling stage load 214*d* is in an "on" mode. The first cooling stage load 214*d* receives power through the "hot" wire RC, as indicated in FIG. 3 by double dashed lines 268. Additionally, the "on-mode" stealing circuit 224 is activated to steal power through the first cooling stage load 214*d*, along a path indicated by dashed line 272. Specifically and for example, current through the load 214*d* is sensed and clipped by the current sensor 228. The sensed signal is reduced by the current transformer 232 and rectified by the rectifier 236. The rectified signal may be filtered and stored by the capacitor 240.

The control 260 detects that the first cooling stage load 214*d* is in the "on" mode. In response the control 260 may operate the switch 256 to connect the "off-mode" stealing circuit 248 with an "off-mode" load, e.g., the first heating stage load 214*e*. "Off-mode" power stealing then may be performed along a path indicated by dashed line 276. Specifically and for example, power may be stolen from the "off-mode" first heating stage load 214*e* through the open relay 218*e* and rectified by the rectifier 252. The rectified signal may be filtered and stored by the capacitor 240.

The control 260 manages provision of power to the thermostat 208 through the capacitor 240 and regulator circuit 244. For example, the control 260 may control operation of the regulator circuit 244 based on a voltage level available from the capacitor 240, e.g., so that the regulator circuit 244 may provide a substantially continuous output voltage 264. In various embodiments, an output voltage of between about 3.3 and 3.6 volts may be provided.

Where, e.g., a user of the climate control system 212 operates the thermostat 208 to request heating, the climate control system 212 may perform heating, e.g., as shown in FIG. 4. The relay 218*e* is closed, and thus the first heating stage load 214*e* is in an "on" mode. The first heating stage load 214*e* receives power through the "hot" wire RC, as indicated by double dashed lines 280. Additionally, the "on-mode" stealing circuit 224 is activated to steal power through the first heating stage load 214*e*, along the path 272. Specifically and for example, current through the load 214*e* is sensed by the current sensor 228. The sensed signal is reduced by the current transformer 232 and rectified by the rectifier 236. The rectified signal may be filtered and stored by the capacitor 240.

The control 260 detects that the first heating stage load 214*e* is in the "on" mode. In response the control 260 may operate the switch 256 to connect the "off-mode" stealing circuit 248 with an "off-mode" load, e.g., the first cooling stage load 214*d*. "Off-mode" power stealing then may be performed along a path 284. Specifically and for example, power may be stolen from the "off-mode" first cooling stage load 214*d* through the open relay 218*d* and rectified by the rectifier 252. The rectified signal may be filtered and stored by the capacitor 240.

Figure 5:
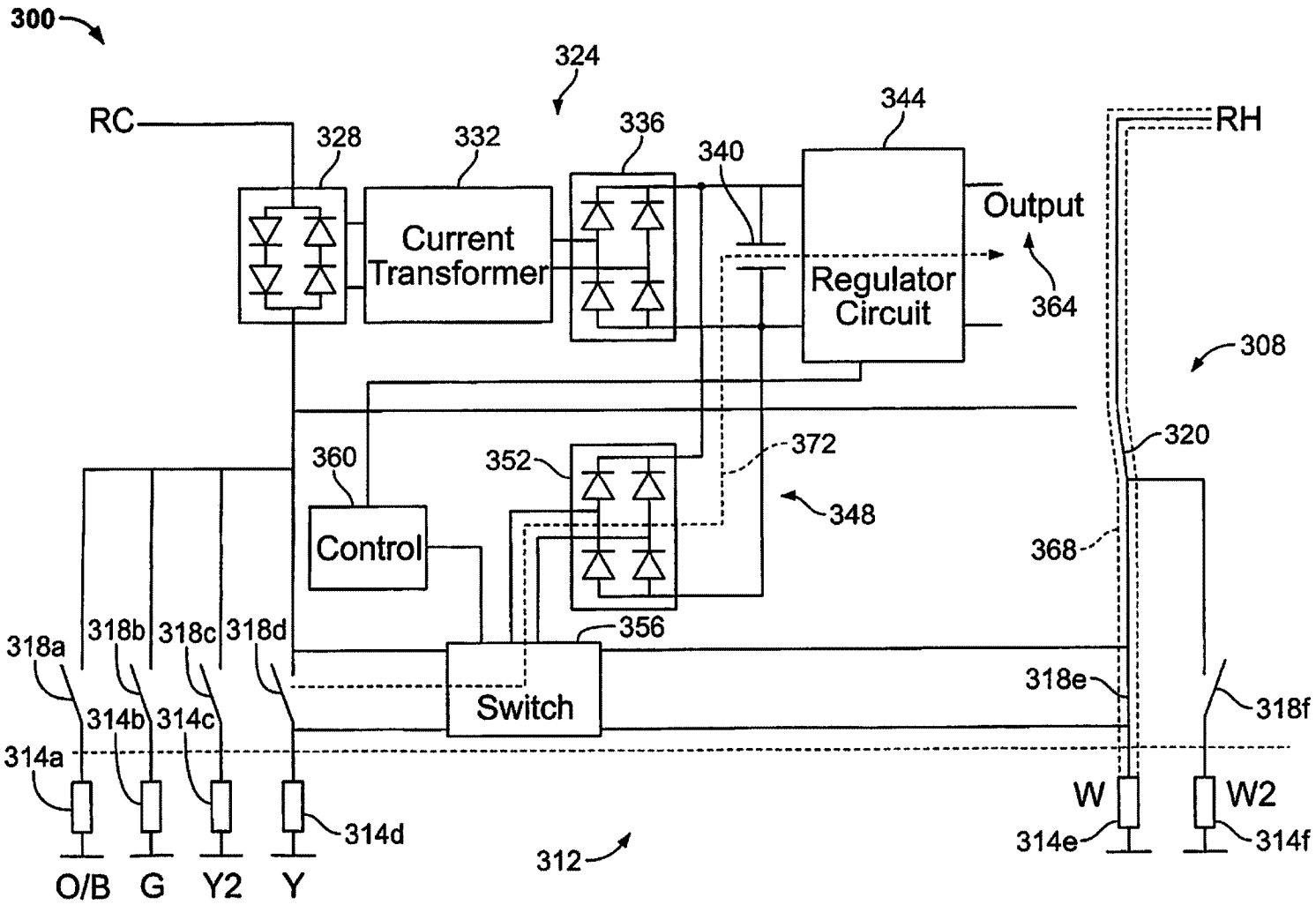

Another example embodiment of a power stealing circuit is indicated generally in FIG. 5 by reference number 300. The power stealing circuit 300 is configured in a thermostat 308 of an example climate control system 312. Possible loads 314*a*-314*f* of the climate control system 312 include two furnace heating stages 314*e* and 314*f* that may be powered through wires W and W2, two cooling stages 314*c* and 314*d* that may be powered through wires Y2 and Y, a fan 314*b* powered through a wire G and a heat pump reversing valve 314*a* powered through a wire O/B. Thermostat relays 318*a*-318*f* are selectively operable to switch each load 314*a*-314*f* into or out of operation in the climate control system 312. The climate control system 312 is configured to use two transformers (not shown). A switch 320 (e.g., a jumper, relay, etc.) is configured to connect the loads 314*e* and 314*f* with a "hot" wire RH. The loads 314*a*-314*d* are connected with a "hot" wire RC.

An "on-mode" stealing circuit 324 of the power stealing circuit 300 includes a current sensor 328, e.g., a clipping circuit connected between the "hot" wire RC and a current transformer 332. A rectifier 336, e.g., a full-wave bridge rectifier, is connected between the current transformer 332 and a capacitor 340. The capacitor 340 is provided between and in parallel with the rectifier 336 and a regulator circuit 344, e.g., a buck circuit. An "off-mode" stealing circuit 348 of the power stealing circuit 300 includes a rectifier 352, e.g., a full-wave bridge rectifier. The rectifier 352 is connected with a switch 356 and also is connected across the capacitor 340. The control 360 detects the voltage of the capacitor 340. If the voltage is high enough (e.g., over fifteen volts), the control 360 may control the regulator circuit 344 to output the voltage 364 to the load. Otherwise, the control 360 doesn't start the regulator circuit 344.

In the present example embodiment, the control 360 manages power stealing and manages the provision of stolen power through the regulator circuit 344 to components of the thermostat 308. Thus, for example, the control 360 monitors voltage across the capacitor 340 and starts or shuts off operation of the regulator circuit 344. If the voltage across the capacitor 340 is too low, the output of the regulator circuit 344 can't support the load. The control 360 also is configured to control the switch 356 for selectively connecting an "off-mode" load with the "off-mode" stealing circuit 348.

The power stealing circuit 300 may be operable, e.g., as follows. Where, e.g., a user of the climate control system 312 operates the thermostat 308 to request heating, the climate control system 312 may perform heating, e.g., as shown in FIG. 5. The relay 318*e* is closed, and thus the first heating stage load 314*e* is in an "on" mode. The first heating stage load 314 receives power through the "hot" wire RH, as indicated by double dashed lines 368.

The control 360 detects that the first heating stage load 314*e* is in the "on" mode. In response the control 360 may operate the switch 356 to connect the "off-mode" stealing circuit 348 with an "off-mode" load, e.g., the first cooling stage load 314*d*. "Off-mode" power stealing then may be performed along a path 372. Specifically and for example, power may be stolen from the "off-mode" first cooling stage load 314*d* and rectified by the rectifier 352. The rectified signal may be filtered and stored by the capacitor 340.

Where, e.g., a user of the climate control system 312 operates the thermostat 308 to request cooling, the climate control system 312 may perform cooling, e.g., in the same or similar manner as discussed with reference to FIG. 3. The relay 318*d* is closed and thus the first cooling stage load 314*d* is in an "on" mode. The first cooling stage load 314*d* receives power through the "hot" wire RC. Additionally, the "on-mode" stealing circuit 324 is activated to steal power through the first cooling stage load 314*d*. Specifically and for example, current through the load 314*d* is sensed by the current sensor 328. The sensed signal is reduced by the current transformer 332 and rectified by the rectifier 336. The rectified signal may be filtered and stored by the capacitor 340.

The control 360 detects that the first cooling stage load 314*d* is in the "on" mode. In response the control 360 may operate the switch 356 to connect the "off-mode" stealing circuit 348 with an "off-mode" load, e.g., the first heating stage load 314*e*. "Off-mode" power stealing then may be performed. Specifically and for example, power may be stolen from the "off-mode" first heating stage load 314*e* and rectified by the rectifier 352. The rectified signal may be filtered and stored by the capacitor 340.

In some two-transformer climate control systems, embodiments are possible in which an "on-mode" stealing circuit is provided for each "hot" wire, to provide for "on-mode" power stealing from both transformers. In such an embodiment, both "on-mode" stealing circuits could be connected, e.g., across a single capacitor to provide input into a buck circuit to provide DC power.

Figure 6:
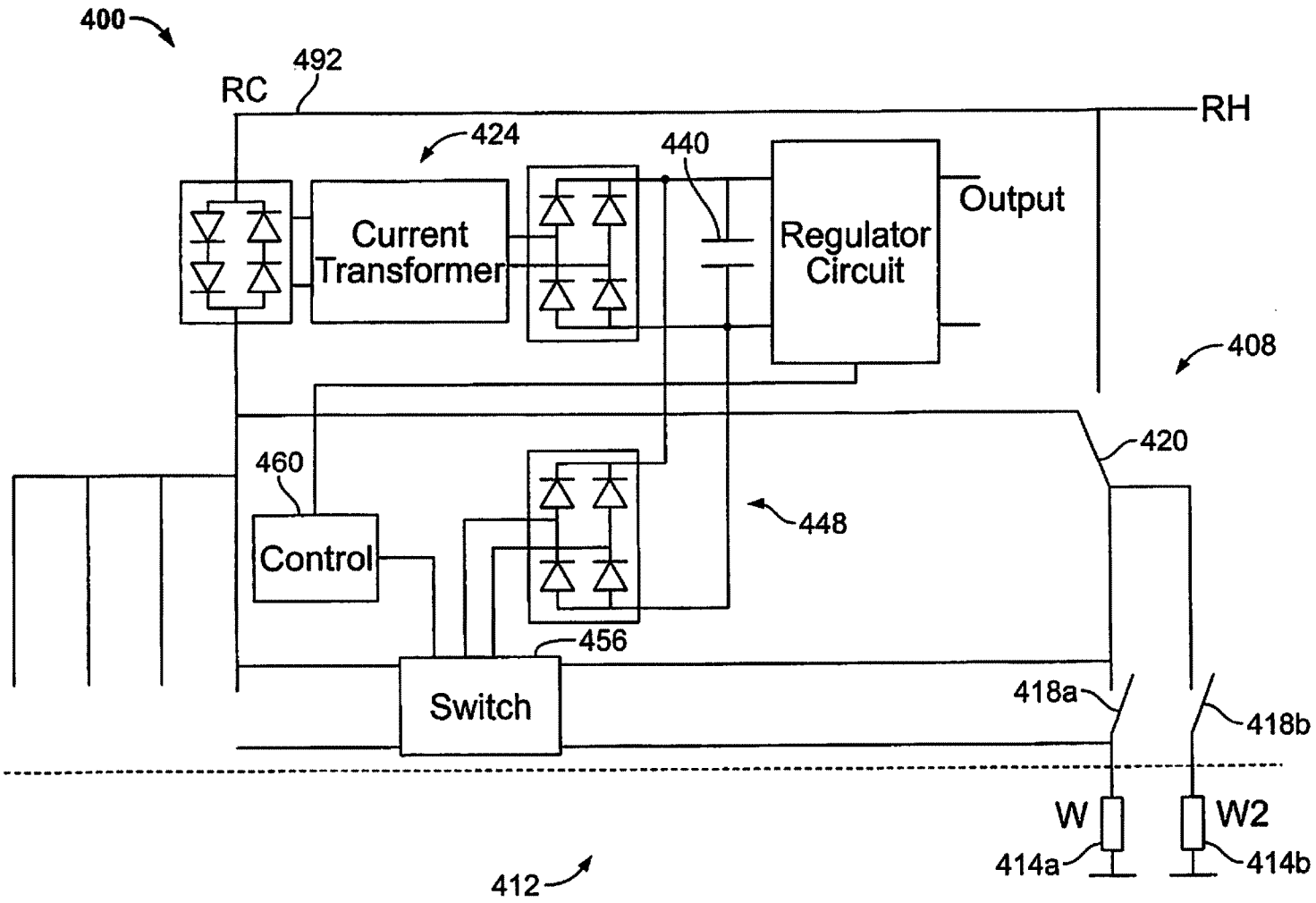

Another example embodiment of a power stealing circuit is indicated generally in FIG. 6 by reference number 400. The power stealing circuit 400 is configured in a thermostat 408 of an example climate control system 412, which is a heat-only system having one transformer. Possible loads of the climate control system 412 include two furnace heating stages 414*a* and 414*b* that may be powered through wires W and W2. Thermostat relays 418*a* and 418*b* are selectively operable to switch each load 414*a* and 414*b* into or out of operation in the climate control system 412. A switch 420 (e.g., a jumper, relay, etc.) is configured with a switch 492 (e.g., a jumper, relay, etc.) to connect the loads 414*a* and 414*b* with a single "hot" wire RH.

The power stealing circuit 400 may be operable, e.g., as follows. Where, e.g., a user of the climate control system 412 operates the thermostat 408 to request heating, the climate control system 412 may perform heating, e.g., as follows. The relay 418*a* is closed, and thus the first heating stage load 414*a* is in an "on" mode. The first heating stage load 414*a* receives power through the "hot" wire RH. Additionally, an "on-mode" stealing circuit 424 is activated to steal power through the first heating stage load 414*a* for storage by a capacitor 440 in the same or a similar manner as previously described. Because the example climate control system 412 does not provide cooling, there are no "off-mode" cooling loads available through which to perform "off-mode" power stealing while heating is being performed. But, e.g., when the load 414*a* is switched off, a control 460 uses a switch 456 to connect the load 414*a* with an "off-mode" stealing circuit 448 so that off-mode power stealing may be performed.

In many conventional thermostats, a jumper needs to be installed between heating and cooling terminals (RH and RC) so that the thermostat may be used in a single-transformer climate control system that provides both heating and cooling. It should be noted that for a given single-transformer system, an embodiment of a thermostat power stealing circuit in which RH and RC terminals of the thermostat are connected through a switch (such as the switch 220 of FIGS. 3 and 4) makes it unnecessary to install a jumper between RH and RC terminals of the thermostat.

Various combinations of on-mode and/or off-mode power stealing could be performed in climate control systems in accordance with various implementations of the disclosure. In various two-transformer embodiments, an "on-mode" stealing circuit could be provided in connection with either transformer or connection with both transformers. Although first stage heating and cooling loads were referred to as being subject to various ways of on-mode and/or off-mode power stealing, other or additional types of loads, including but not limited to second stage loads, heat pump reversing valves, etc. could be subject to various ways of on-mode and/or off-mode power stealing.

Various climate control system types may lend themselves to various types of power stealing. For example, in a single-transformer system that includes a fan, a compressor, and a furnace, on-mode power may be stolen, e.g., from the compressor. In such case, a switch may be control-activated so as to provide a connection for stealing off-mode power, e.g., from the furnace. Conversely, on-mode power may be stolen, e.g., from the furnace. In such case, a switch may be control-activated so as to provide a connection for stealing off-mode power, e.g., from the compressor.

In a single-transformer, cooling-only system that includes a fan and a compressor, on-mode power may be stolen, e.g., from the compressor. When the compressor is switched off, off-mode power may be stolen from the compressor. Thus, power stealing may be performed substantially continuously in such a system. In a single-transformer system that has a heat pump, on-mode power may be stolen, e.g., from a compressor and/or heater. Off-mode power may be stolen, e.g., from the heater. In various embodiments, power stealing may be provided so as to take into account the various impedances of climate control system loads. For example, a typical fan load may be about 2 kΩ, a typical first-stage cooling load may be about 1 kΩ, and a typical first-stage heating load may be about 667Ω.

The foregoing power stealing circuit examples can be seen to embody various example methods of performing power stealing for a climate control system controller. For example, one implementation of a control-performed method includes monitoring a plurality of climate control system loads. Based on the monitoring, the control may detect whether one of the loads is in an "on" mode. In response to the detecting, the control may actuate power stealing from an "off-mode" load. Additionally or alternatively, a control in a climate control system may actuate power stealing from an "off-mode" load of the climate control system regardless of whether or not another load of the climate control system is in an "on" mode.

The foregoing apparatus, systems and methods make it possible to provide a thermostat with power sufficient to operate a wireless transceiver or other wireless module. Power stealing can be particularly effective in embodiments in which power can be stolen from both "on-mode" (e.g., a regular load situation) and "off-mode" loads at the same time. Using a capacitor as an energy storage medium makes it possible to provide substantially continuous power to a transceiver. Embodiments of the regulator circuit can provide highly efficient power transfer. Further, in various embodiments, power can be stolen from a number of different loads, which can be changed in response to different operating conditions in a climate control system.

Although various embodiments of the disclosure are described with reference to thermostats, other or additional configurations are possible in relation to devices, controllers, controls, and control systems other than thermostats. Power stealing could be implemented, e.g., in relation to a device that has access to two or more load circuits, such that at a given time one of the circuits would be available from which to steal power in accordance with aspects of the present disclosure.

Thus, exemplary embodiments or implementations are disclosed of a controller for use in a climate control system, the controller comprising a power stealing circuit configured to steal power from a first load that is in an "on" mode and from a second load that is in an "off" mode, the stealing performed from the first and second loads at the same time.

The controller may further comprise a processor configured to: detect operation of the first load in the "on" mode; and selectively connect the power stealing circuit with the second load in the "off" mode in response to detection of the first load in the "on" mode. The power stealing circuit of the controller may comprise a regulator circuit and a capacitor configured to provide input to the regulator circuit; and the processor is configured to control operation of the regulator circuit based on a voltage across the capacitor.

The power stealing circuit may comprise: an "off-mode" stealing circuit; and a processor-controlled switch for connecting the "off-mode" stealing circuit with the second load based on operation of the first load in the "on" mode.

The power stealing circuit may include a current transformer through which power is stolen from the first load in the "on" mode. The power stealing circuit may include a capacitor and regulator circuit through which power is provided to the controller and/or one or more circuits ancillary to the controller.

The controller may be a thermostat.

Additionally or alternatively, exemplary embodiments or implementations are disclosed of a controller for use in a climate control system, the controller comprising a power stealing circuit; and a processor configured to: detect "on-mode" operation of a first load of the climate control system; and selectively connect the power stealing circuit with a second load in an "off" mode in response to detection of the "on-mode" operation of the first load; whereby the power stealing circuit is configured to steal power from the first and second loads at the same time.

In the foregoing controller, the power stealing circuit may comprise a capacitor and a regulator circuit configured to provide an output voltage, and the processor may be further configured to monitor the capacitor, and control the regulator circuit based on the monitoring. The power stealing circuit may further comprise a switch controllable by the processor to selectively connect the power stealing circuit with the second load. The power stealing circuit may further comprise an "on-mode" stealing circuit and an "off-mode" stealing circuit each selectively switchable between loads of the climate control system.

Additionally or alternatively, exemplary embodiments or implementations are disclosed of a control-performed method of stealing power in a climate control system to operate a controller of the climate control system. The method comprises: monitoring a plurality of loads of the climate control system; detecting that one of the loads is in an "on" mode; and in response to the detecting, actuating power stealing from one of the loads that is in an "off" mode; the method being performed while power is being stolen from the one of the loads that is in the "on" mode. The plurality of loads may be powered from a single transformer. The method may further comprise combining power stolen from the load in the "off" mode with power stolen from the load in the "on mode" to provide a voltage output for use by the controller.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Or, for example, the term "about" as used herein when modifying a quantity of an ingredient or reactant of the invention or employed refers to variation in the numerical quantity that can happen through typical measuring and handling procedures used, for example, when making concentrates or solutions in the real world through inadvertent error in these procedures; through differences in the manufacture, source, or purity of the ingredients employed to make the compositions or carry out the methods; and the like. The term "about" also encompasses amounts that differ due to different equilibrium conditions for a composition resulting from a particular initial mixture. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A controller for use in a climate control system, the controller comprising:

a power stealing circuit configured to steal power from a first load that is in an "on" mode and from a second load that is in an "off" mode, the stealing performed from the first and second loads at the same time; and wherein the power stealing circuit comprises a capacitor and a regulator circuit through which power is provided to the controller.

2. The controller of claim 1, further comprising a processor configured to:

detect via a connected detector an operation of the first load in the "on" mode; and selectively connect via connected switching circuitry the power stealing circuit with the second load in the "off" mode in response to detection of the first load in the "on" mode.

3. The controller of claim 1, wherein:

the capacitor is configured to provide input to the regulator circuit; and the processor is configured to control via a switch an operation of the regulator circuit based on a voltage across the capacitor.

4. The controller of claim 1, wherein the power stealing circuit comprises:

an "off-mode" stealing circuit that includes a rectifier connected with a processor-controlled switch and connected across the capacitor; and the processor-controlled switch for connecting the "off-mode" stealing circuit with the second load based on operation of the first load in the "on" mode.

5. The controller of claim 1, wherein the power stealing circuit comprises a current transformer through which power is stolen from the first load in the "on" mode.

6. A controller for use in a climate control system, the controller comprising a power stealing circuit configured to steal power from a first load that is in an "on" mode and from a second load that is in an "off" mode, the stealing performed from the first and second loads at the same time; wherein the power stealing circuit comprises a capacitor and a regulator circuit through which power is provided to one or more circuits ancillary to the controller.

7. The controller of claim 1, comprising a thermostat.

8. The controller of claim 1, wherein the power stealing circuit further comprises:

an "on-mode" stealing circuit that includes a current sensor, a current transformer connected with the current sensor, and a rectifier connected between the current transformer and the capacitor; and an "off-mode" stealing circuit that includes a rectifier connected with a switch and connected across the capacitor.

9. A controller for use in a climate control system, the controller comprising:

a power stealing circuit; and a processor configured to:

detect via a connected detector an "on-mode" operation of a first load of the climate control system; and selectively connect via connected switching circuitry the power stealing circuit with a second load in an "off" mode in response to detection of the "on-mode" operation of the first load;

whereby the switching circuitry is configured to control the power stealing circuit that is configured to steal power from the first and second loads at the same time.

10. The controller of claim 9, wherein:

the power stealing circuit comprises a capacitor and a regulator circuit configured to provide an output voltage; and the processor is further configured to:

monitor the capacitor; and control via the connected switching circuitry the regulator circuit based on the monitoring.

11. The controller of claim 9, wherein the switching circuitry comprises a switch controllable by the processor to selectively connect the power stealing circuit with the second load.

12. The controller of claim 9, wherein the power stealing circuit further comprises:

an "on-mode" stealing circuit that includes a current sensor, a current transformer connected with the current sensor, and a rectifier connected with the current transformer; and an "off-mode" stealing circuit that includes a rectifier connected with the connected switching circuitry.

13. The controller of claim 9, comprising a thermostat.

14. A control-performed method of stealing power in a climate control system to operate a controller of the climate control system, the method comprising:

monitoring a plurality of loads of the climate control system;

detecting that one of the loads is in an "on" mode; and in response to the detecting, actuating power stealing from one of the loads that is in an "off" mode;

the method performed while power is being stolen from the one of the loads that is in the "on" mode.

15. The method of claim 14, wherein the plurality of loads are powered from a single transformer.

16. The method of claim 14, further comprising combining power stolen from the load in the "off" mode with power stolen from the load in the "on mode" to provide a voltage output for use by the controller.

17. The method of claim 14, wherein the controller is a thermostat installed in the climate control system without installing a jumper between heating and cooling terminals of the thermostat.

18. The method of claim 14, further comprising controlling a switch to select between the loads.

19. The method of claim 14, further comprising:

monitoring a capacitor configured to provide input to a regulator circuit of the power stealing circuit where the regulator circuit provides an output voltage for use by the controller; and controlling operation of the regulator circuit based on the monitoring.

20. The method of claim 19, wherein the operation of the regulator circuit is controlled based on a voltage across the capacitor.

21. The controller of claim 1, wherein power is provided through the capacitor and the regulator circuit to one or more circuits ancillary to the controller.

22. A controller for use in a climate control system, the controller comprising a power stealing circuit configured to steal power from a first load that is in an "on" mode and from a second load that is in an "off" mode, the stealing performed from the first and second loads at the same time, wherein the power stealing circuit comprises:

an "on-mode" stealing circuit including a current sensor, a current transformer connected with the current sensor, and a rectifier connected between the current transformer; and an "off-mode" stealing circuit including a rectifier connected with a switch.

23. The controller of claim 22, wherein:

the controller further comprises a regulator circuit and a capacitor between and in parallel with the regulator circuit and the rectifier of the "on-mode" stealing circuit; and the rectifier of the "off-mode" stealing circuit is connected across the capacitor.

24. The controller of claim 22, comprising a thermostat.

* * * * *